US005261547A

United States Patent [19]

Finke

[11] Patent Number: 5,261,547

[45] Date of Patent: Nov. 16, 1993

[54] METHODS AND COMBINATIONS FOR SEALING CORKED BOTTLES

[76] Inventor: Stephan J. Finke, 542 Avenue Del Oro, Sonoma, Calif. 95476

[21] Appl. No.: 33,054

[22] Filed: Mar. 10, 1993

Related U.S. Application Data

[63] Continuation of Ser. No. 897,370, Jun. 11, 1992, abandoned, which is a continuation-in-part of Ser. No. 842,237, Feb. 26, 1992, which is a continuation-in-part of Ser. No. 814,863, Dec. 30, 1991, abandoned.

[51] Int. Cl.[5] ..... B65D 39/00

[52] U.S. Cl. ..... 215/233; 215/230; 215/273; 215/364

[58] Field of Search ..... 215/230, 232, 233, 273, 215/292, 355, 363, 364

[56] References Cited

U.S. PATENT DOCUMENTS

| | | | |
|---|---|---|---|
| 505,301 | 9/1893 | Schroeder | 215/233 |
| 596,366 | 12/1897 | Graham | 215/273 |
| 677,900 | 7/1901 | Stern . | |
| 714,326 | 11/1902 | Parks | 215/233 |
| 944,030 | 12/1909 | Giffin | 215/233 |
| 1,296,283 | 3/1919 | Gillinder | 215/233 |
| 1,377,568 | 5/1921 | Ellis et al. . | |
| 1,731,194 | 10/1929 | Ellis | 215/232 X |
| 1,973,758 | 9/1934 | Gray et al. | 215/364 X |
| 2,228,836 | 1/1941 | Walter | 215/56 |
| 2,741,388 | 4/1956 | Rubin | 215/39 |
| 3,235,111 | 2/1966 | Whitton, Jr. et al. | 215/363 X |
| 3,984,022 | 10/1976 | Babiol | 215/355 |

*Primary Examiner*—Allan N. Shoap
*Assistant Examiner*—Vanessa Caretto
*Attorney, Agent, or Firm*—Todd A. Noah

[57] ABSTRACT

A liquified thermoplastic material is injected into the neck of a corked bottle and placed upon the top of the cork so that when the thermoplastic material hardens, it forms a water resistant seal with the interior surface of the bottle neck and the cork. In forming the seal, the entire thermoplastic material remains inside the bottle neck leaving the exterior of the bottle free from messy or harmful residue. The bottle neck further comprises a groove around the interior surface near the mouth. A cover layer can be snapped into the groove such that it lays on top of the thermoplastic material for ornamentation and labeling purposes and to further secure the cork in place within the bottle neck.

10 Claims, 1 Drawing Sheet

METHODS AND COMBINATIONS FOR SEALING CORKED BOTTLES

CROSS-REFERENCE TO RELATED APPLICATION

This is a continuation of co-pending application Ser. No. 07/897,370 filed on Jun. 11, 1992, now abandoned, which is a continuation-in-part of Ser. No. 07/842,237 filed on Feb. 26, 1992, which is a continuation-in-part of Ser. No. 07/814,863 filed on Dec. 30, 1991 now abandoned.

TECHNICAL FIELD OF THE INVENTION

The present invention relates to methods for sealing corked bottles, and in particular for sealing corked bottles containing beverages including wines.

BACKGROUND OF THE INVENTION

Existing methods of sealing corked bottles have several disadvantages. One current method of sealing corked bottles requires the use of thin metal foils containing lead, which are now widely believed to leave traces of harmful lead particles on the glass surface of the bottle after removal. In view of the recent bans in many states on the use of lead, this method is undesirable.

Another conventional method utilizes external seals made of plastic. This is undesirable for many products because plastic seals are not considered suitable for premium beverages, including higher-priced wines.

Current methods have also attempted to employ wax seals. However, the current method involves forming wax seals by dipping the opening and neck of the bottle in wax. This method has the disadvantages of requiring the bottle to be inverted during the sealing process and of leaving a messy residue of wax when the bottle is opened.

All of the conventional sealing methods described above result in seals which cover all or most of the exterior of the glass neck of the bottle with the sealing material.

In contrast to the existing sealing methods, this invention will not leave any harmful or messy residue on the exterior of the bottle neck, will produce an elegant seal suitable for use on premium beverage bottles, including higher-priced wines, and will leave the entire exterior surface of the glass neck of the bottle exposed. It will also allow for the use of embossing on the paper or plastic cover.

SUMMARY OF THE INVENTION

One object of the present invention is to provide a method for sealing a corked bottle which utilizes a thermoplastic material injected in liquified form into the mouth of the neck of a corked bottle and placed on top of the cork wherein it hardens and forms a seal with the interior surface of the bottle neck and the cork.

Another object of the present invention is to provide a plastic or paper cover on top of the thermoplastic seal layer such that the cover snaps into a groove around the inside of the bottle neck.

Objects and advantages other than those set forth above will be apparent from the following description when read in conjunction with the accompanying drawings.

DETAILED DESCRIPTION OF THE INVENTION

Figure 1:
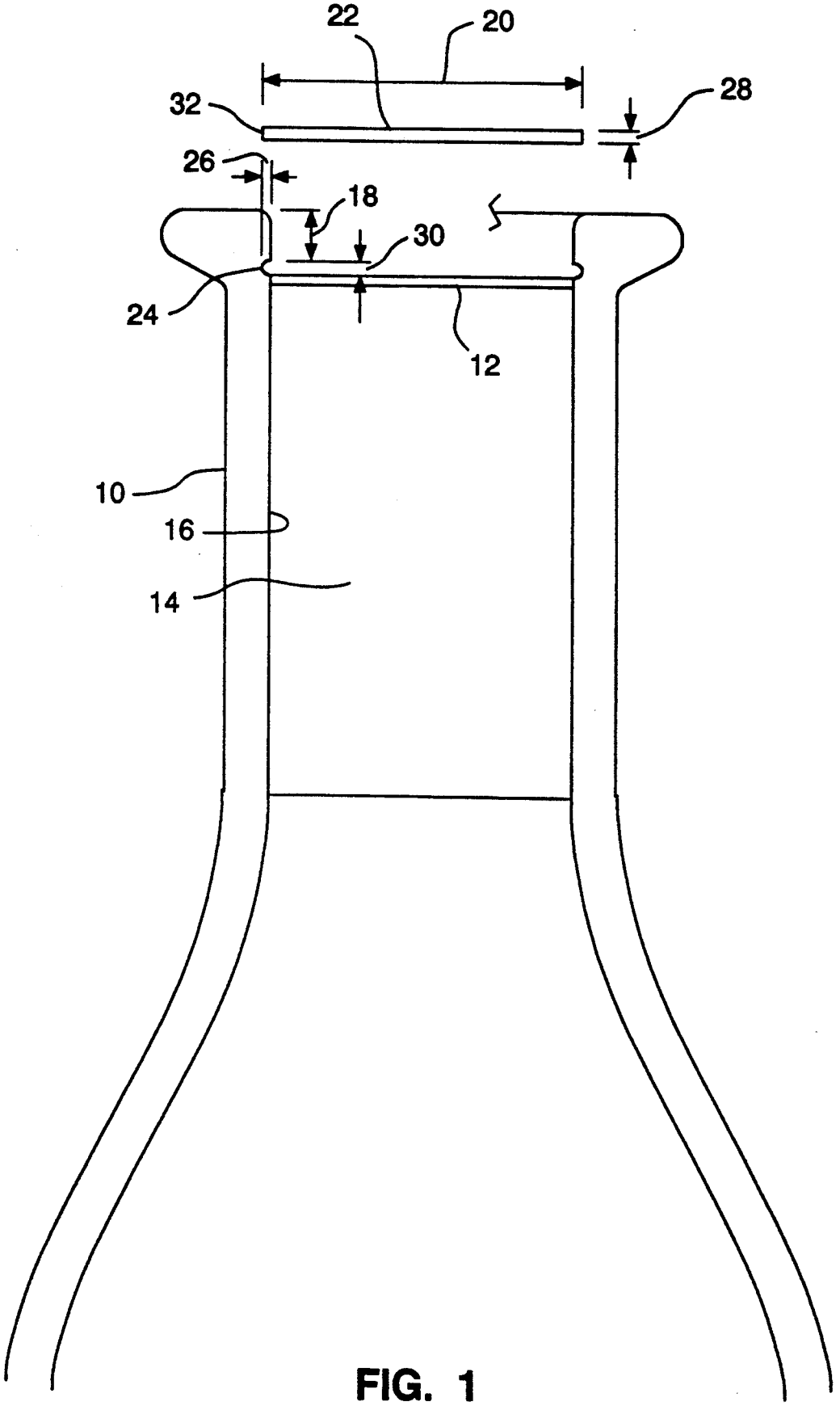
FIG. 1 is a cross-sectional view of a neck of a corked bottle showing a cork and the thermoplastic seal layer positioned therein and further showing a groove for receiving the cover.

The present invention is directed to a method and apparatus for sealing a corked bottle. As shown in FIG. 1, this sealing method utilizes a thermoplastic material which is injected into the mouth of a corked bottle neck 10 to form a thermoplastic layer 12 on top of the cork 14.

In carrying out the method of the present invention, the thermoplastic material in liquified form is injected into the mouth of a corked bottle to form a layer on top of the cork 14. When the thermoplastic material hardens, the outer surface of the layer 12 forms a moisture resistant seal with the interior surface 16 of the bottle neck 10 and the bottom surface of the layer 12 forms a moisture resistant seal with the top surface of the cork 14. The amount of the liquified thermoplastic material to be injected is selected so that when the thermoplastic layer 12 is formed and removably secured to the top of the cork 14 and to the interior surface 16 of the bottle neck, all of the thermoplastic material is contained entirely within the bottle neck. This alleviates the messy or harmful residue on the exterior of the bottle that occurs when bottles are sealed according to the current methods.

The preferred embodiment of the claimed method utilizes 0.05 to 0.15 g (approximately 1 to 3 drops) of liquified thermoplastic material. In this preferred embodiment, the thermoplastic layer 12 resides entirely below the mouth of the bottle neck 10. This permits shipping of the bottles upside down without damaging the top of the thermoplastic layer.

The thermoplastic material is selected such that it will melt and seal the inside of the bottle neck under temperature conditions compatible with beverage manufacture and handling. A suitable melting point is between 80° and 180° F. The thermoplastic material should also be chosen in light of prevailing standards for the contact of materials by foods and beverage products. Non-toxic, substantially inert materials are preferred for this application. The thermoplastic material should also be able to cleanly release its seal when it is removed from the bottle neck with the cork. Ideally, the thermoplastic material will not crumble or substantially fracture when pierced with a cork screw.

There is a large number of thermoplastic materials, both natural and organically synthesized, as well as aggregations or combinations or mixtures of materials, which will fit the above-noted criteria. Natural beeswax is a preferred material because of its demonstrated compatibility with food and beverage products. One disadvantage, however, of beeswax is its low melting point which make handling and storage difficult. Another preferred wax is granulate which would be suitable for high speed assembly line use of the thermoplastic layer.

The selection of thermoplastic materials suitable for the thermoplastic layer from among organic polymer thermoplastic materials and from among naturally occurring wax materials is within the skill of the ordinary artisan.

As further seen in FIG. 1, the present invention utilizes a circular cover 22 over the thermoplastic layer 12, which is removably secured in a groove 24 around the interior surface 16 of the bottle neck 10. The groove 24 is positioned above and adjacent to the thermoplastic layer 12 and has a depth 26 for receiving the outer edge 32 of the cover 22. This holds the cover 22 tightly in place on top of and adjacent to the thermoplastic layer 12 which in turn, helps to retain the cork in place.

The diameter of the cover 22 is slightly larger than the diameter of the interior surface 16 of the bottle neck. Thus, when the cover 22 is inserted into the mouth 20 of the bottle neck and pressed down into place on top of the thermoplastic layer 12, the outer edge 32 of the cover 22 snaps into the groove 24 around the inside of the bottle neck 10. The width 30 of the groove will vary depending upon the thickness of the cover 22 used. The advantage of using the groove 24 for securing the cover 22 is that it avoids the use of adhesives.

In a preferred embodiment, the inside diameter of the bottle neck is approximately 12/32 of an inch and the diameter of the cover 22 is approximately 13/32 of an inch, with the groove 24 having a depth 26 of approximately 1/64 of an inch and a width 30 of approximately 1/64 of an inch. The preferred thickness 28 of the cover 22 is approximately 1/32 to 1/64 an inch.

The cover 22 may be made of plastic or rigid paper of various weights and must be capable of being pierced by a cork screw. The cover layer 22 presents unlimited opportunity for design and decoration since the top of the cover layer 22 may be plain, embossed, printed or otherwise.

In practicing a preferred embodiment of the claimed method, as seen in FIG. 1, the cork 14 is inserted into the bottle neck 10 so that when the thermoplastic layer 12 and cover 22 are positioned therein, the distance 18 from the top of the cover 22 to the top edge of the mouth 20 of the bottle is at least 1/64 of an inch. The advantages of this are twofold. First, this prevents any of the disc material from melting over the mouth 20 of the bottle and onto the exterior of the bottle neck during the sealing process. Second, this permits the bottles to be stored and shipped upside down with each bottle supported on the edge of the opening of the bottle neck without putting pressure on the thermoplastic layer 12 or the cover 22.

Once the cork is in place in the bottle neck, thermoplastic material in liquid form is injected on to the top surface of the cork 14 where it hardens to form a moisture resistant seal with the interior surface 16 of the bottle neck 10 and the top surface of the cork 14. Once the thermoplastic layer 12 is formed, a cover 22 is inserted into the mouth 20 of the bottle on to the top of the thermoplastic layer 12. By pressing down on the center of the cover 22, the outer edge of the cover 22 will move radially outward from the center of the cover until snapping into place in the groove 24. When properly snapped into place in the groove 24, the cover 22 will lay flat on top of the thermoplastic layer 12.

In practicing a preferred embodiment of the claimed invention, as seen in FIG. 1, the thickness 28 of the cover layer 22 may be selected so that the cover layer 22 is displaced entirely within the bottle neck. This permits the bottles to be stored and shipped upside down with each bottle supported on the edge of the opening of the bottle neck without putting pressure on the cover layer 22. Although this is a preferred embodiment of the present invention, the height of the cover layer 22 may also be selected such that the cover layer 22 extends beyond the edge of the bottle opening.

While the present invention has been described in detail by way of illustration and example for purposes of clarity of understanding, it is understood that certain changes and modifications may be made within the spirit of the invention and the scope of the appended claims.

What is claimed is:

1. A combination comprising:

a) a corked bottle having a cylindrical neck terminating in a mouth having a top edge, said neck having a cylindrical interior surface and a groove near said top edge, said groove having a depth;

b) a cylindrical cork having a top flat surface, said cork being displaced entirely within said neck;

c) a thermoplastic layer having a top, bottom and outer surface, said thermoplastic layer being displaced entirely within said neck above said cork, wherein said bottom surface of said thermoplastic layer is removably secured to said cork top surface and wherein said thermoplastic outer surface is removably secured to said interior neck surface, to create a seal to retain moisture within said cork and said neck; and d) a cover having an outer edge wherein said outer edge is secured in said groove.

2. The combination of claim 1 wherein said thermoplastic material is capable of melting at a temperature between 80 and 180 degrees Fahrenheit.

3. The combination of claim 1 wherein said thermoplastic material is selected from the group consisting of beeswax, granulate wax and mixtures thereof.

4. The combination of claim 1 wherein said cover is made of paper.

5. The combination of claim 1 wherein said cover is made of plastic.

6. The combination of claim 1 wherein said cover diameter is approximately 13/32 of an inch.

7. The combination of claim 1 wherein said neck inside diameter is approximately 12/32 of an inch.

8. The combination of claim 1 wherein said depth of said groove is approximately 1/64 of an inch.

9. The combination of claim 1 wherein said cover is positioned in said neck at a distance from said neck top edge of at least 1/64 of an inch.

10. The combination of claim 1 wherein said cover has a top and a bottom surface, said top surface adapted to receive indicia.

* * * * *